US008449298B2

(12) United States Patent
Reardon et al.

(10) Patent No.: US 8,449,298 B2
(45) Date of Patent: May 28, 2013

(54) OPTICAL ALIGNMENT DEVICE FOR A WEAPON SIMULATOR USING AN OPTICAL SIMULATION BEAM

(76) Inventors: Peter Reardon, Orlando, FL (US); Steven Preston, Winter Springs, FL (US); Jan J. Ksel, Casselberry, FL (US); Thomas Penner, Apopka, FL (US)

( * ) Notice: Subject to any disclaimer, the term of this patent is extended or adjusted under 35 U.S.C. 154(b) by 268 days.

(21) Appl. No.: 12/983,438

(22) Filed: Jan. 3, 2011

(65) Prior Publication Data

US 2012/0171643 A1 Jul. 5, 2012

(51) Int. Cl.
*F41G 3/26* (2006.01)

(52) U.S. Cl.
USPC ..... 434/21; 434/11; 434/16; 434/19

(58) Field of Classification Search
USPC ..... 434/11, 17, 19, 21, 20
See application file for complete search history.

(56) References Cited

U.S. PATENT DOCUMENTS 4,422,758 A * 12/1983 Godfrey et al. ..... 356/152.1
6,366,349 B1 * 4/2002 Houde-Walter ..... 356/153
6,406,298 B1 * 6/2002 Varshneya et al. ..... 434/21
6,705,037 B2 * 3/2004 Van Kirk ..... 42/126
6,887,079 B1 * 5/2005 Robertsson et al. ..... 434/22
7,496,241 B1 * 2/2009 Reneker et al. ..... 382/275
2004/0076928 A1 * 4/2004 Renntoft ..... 434/21

* cited by examiner

*Primary Examiner* — Robert J Utama
*Assistant Examiner* — Robert P Bullington
(74) *Attorney, Agent, or Firm* — Roetzel & Andress; Jason S. Miller

(57) ABSTRACT

An alignment device for a weapon that generates a simulation beam and an alignment beam used to align the simulation beam with the weapon's sight. The device can be secured to the weapon during the alignment process, after which it can be removed. The device includes a housing that can be mounted on the weapon so that its optical receiving port intersects both the optical alignment beam generated by the optical transmitter and the sighting axis of the weapon's sight. The optical receiving port includes an optical arrangement for receiving the alignment beam and focusing it on a projection screen located inside the housing. An image of the alignment beam on the projection screen can be viewed through the sight. The alignment beam is parallel to the simulation beam. Thus, by centering the alignment beam in the sight, the alignment beam, and hence the simulation beam, will be properly aligned.

24 Claims, 7 Drawing Sheets

OPTICAL ALIGNMENT DEVICE FOR A WEAPON SIMULATOR USING AN OPTICAL SIMULATION BEAM

BACKGROUND

Live combat simulation systems using firearm-like devices emulating or simulating real-life firearms, such as in laser tag or combat games, allow individuals to participate in realistic combat simulations in a range of different indoor and outdoor environments without substantially endangering their own, and others', personal safety. Such systems can be used for military training, entertainment, sport, team building and/or morale building.

As an example, a system often used in military training is the Multiple Integrated Laser Engagement System (MILES), which is a modern realistic force-on-force training system. As a standard for direct-fire tactical engagement simulation, MILES is a system employed for training soldiers by the U.S. Army, Marine Corps and Air Force and international forces such as the Royal Netherlands Marine Corps, Kuwait Land Forces and the UK Ministry of Defense.

A simulation system such as MILES allows gunners to fire infrared laser beams that simulate bullets from the same weapons and vehicles that they would use in actual combat. These simulated direct-fire events produce realistic audio/visual effects and casualties, identified as a "hit," "miss" or "kill." The events are then recorded, replayed and analyzed in detail during After Action Reviews, which give commanders and participants an opportunity to review their performance during the training exercise. Unique player ID codes and Global Positioning System (GPS) technology may be used to ensure accurate data collection, including casualty assessments and participant positioning.

In simulated firing with a laser, an optical transmitter mounted on a weapon emits a laser beam. The beam can be detected by one or more detectors mounted on one or more targets.

When an optical transmitter is mounted on a weapon, its firing direction must be aligned with the firing directing of the weapon. This can be accomplished by aiming the weapon with its regular sight at a target that is designed so as to be able to sense the simulated firing of the optical transmitter. The optical transmitter is fired, and the target is observed to determine the locations of the hits in relation to the aiming of the weapon. If deviations are present, the firing direction of the optical transmitter is adjusted by means of an adjusting device built into the optical transmitter until the weapon and the optical transmitter are jointly aligned. It may also be necessary to repeat the alignment process if the optical transmitter is jostled somewhat from its position, e.g. as a result of exposure to minor impacts. One problem with this alignment technique is that may require trial and error to achieve the proper alignment by observing through the site the location at which the target is hit each time the position of the optical transmitter is adjusted. Thus, while a satisfactory approach in principle, this alignment technique is cumbersome and time consuming to execute, and requires special equipment to render the invisible laser beam visible.

Alternatively, an alignment fixture or device may be used. In this alignment technique the optical transmitter mounted on the weapon transmits a simulation beam along a simulation axis as well as an alignment beam along an alignment axis that is parallel with the simulation axis. The weapon sight defines an aiming axis that indicates the direction in which a round will leave the weapon when live ammunition is fired. To enable alignment of the simulation axis of the optical transmitter with the aiming axis, an alignment device or fixture is mounted on the weapon in front of the optical transmitter. The alignment device includes an off-axis curved mirror that reflects the alignment beam and the image of a target back into the sight. The alignment beam and the target are thus visible through the sight, so that the alignment axis and the simulation axis can be collectively adjusted using appropriate means so that they coincide with the sight axis.

On problem with an alignment device of the type described above is that it requires a relatively bulky housing to contain both the mirror and the target. For instance, in one currently available alignment device the distance between the off-axis mirror and the target is approximately 1 meter. Thus, such an alignment device can be both cumbersome and expensive.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY OF THE INVENTION

A small form-factor alignment device is provided for a weapon that generates a simulation beam and an alignment beam that is used to properly align the simulation beam with the weapon's sight. The device is sufficiently small so that it can be easily secured to the weapon during the alignment process, after which it can be removed.

In one implementation, the device includes a housing that can be mounted on the weapon so that its optical receiving port intersects both the optical alignment beam generated by the optical transmitter and the sighting axis of the weapon's sight. The optical receiving port includes an optical arrangement for receiving the alignment beam and focusing it on a projection screen located inside the housing. An image of the alignment beam on the projection screen can be viewed through the sight by a user. In one particular implementation, the alignment beam is parallel to the simulation beam. Thus, by centering the alignment beam in the sight, the alignment beam, and hence the simulation beam, will be properly aligned.

DETAILED DESCRIPTION

Figure 1:
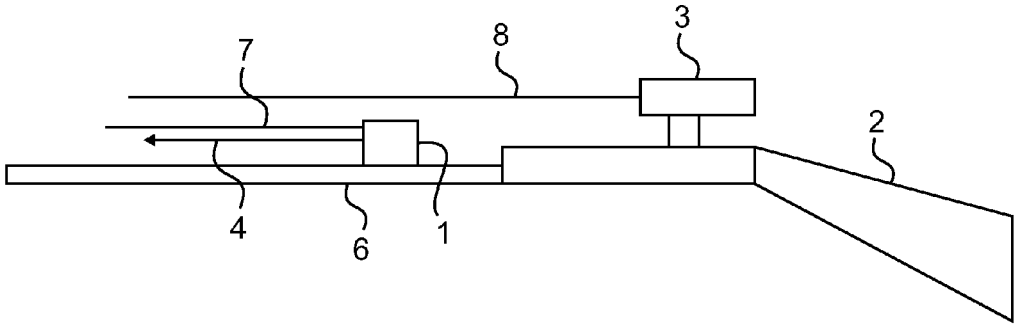
FIG. 1 shows a weapon such as a firearm that includes an optical transmitter or performing simulated combat training.

FIG. 1 shows a weapon 2 such as a firearm that includes an optical transmitter 1 for performing simulated combat training. The weapon 2 may be any suitable firearm that is constructed for the purpose of performing simulations or is retrofitted for this purpose. The optical transmitter 1 is mounted on the barrel 6 of the weapon 2 or firearm housing. The transmitter 1 is mechanically and operationally connected to the weapon 2 in such a manner that it can detect when the trigger is depressed and emit an optical beam in response thereto.

The weapon 2 includes a sight 3 that defines a sighting axis 8. The sighting axis 8 defines the direction along which a shot will leave the weapon 2 when firing with live ammunition. The optical transmitter 1 emits a simulation beam 4 along a simulator axis. The simulation beam 4 may have a wavelength in the infrared range or in any other suitable range of the electromagnetic spectrum. The optical transmitter 1 also emits an alignment beam 7 along an alignment axis, which is parallel to the simulator axis. The alignment beam 7 has a wavelength within the visible portion of the electromagnetic spectrum.

Figure 2:
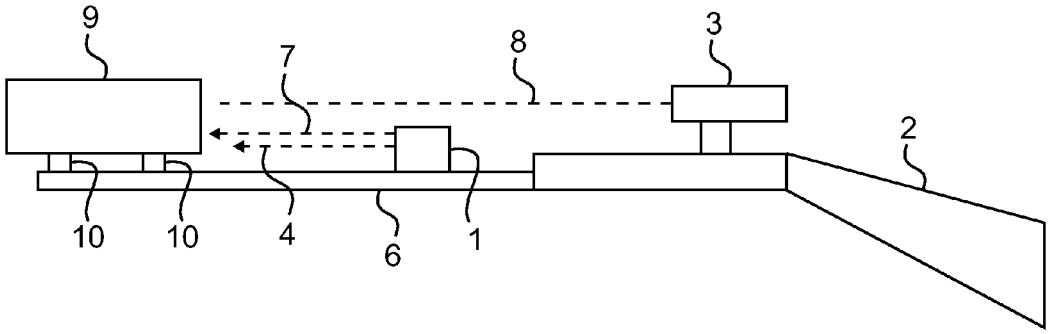
FIG. 2 shows the weapon of FIG. 1 with an optical alignment device secured to the weapon barrel.

In order to provide a realistic simulation exercise, the simulator axis of the simulation beam 4 needs to be brought into alignment with the sighting axis 8. With this configuration, a gunner can train using the weapon sight 3 as he or she would in combat. In accordance with the methods, devices and techniques described herein, alignment can be accomplished using an alignment device 9 such as shown in FIG. 2. In FIGS. 1 and 2, as well as the figures that follow, like elements are denoted by like reference numerals As shown, the alignment device 9 is mounted on the barrel 6 of the weapon 2 in front of the optical transmitter 1 and intercepts the optical axis of the sighting axis 8 as well as the axes of the alignment beam 7 and the simulation beam 4. The alignment device 9 has mounting brackets 10 to releasably attach the alignment device 9 to the barrel 6 of the weapon 2.

Figure 3:
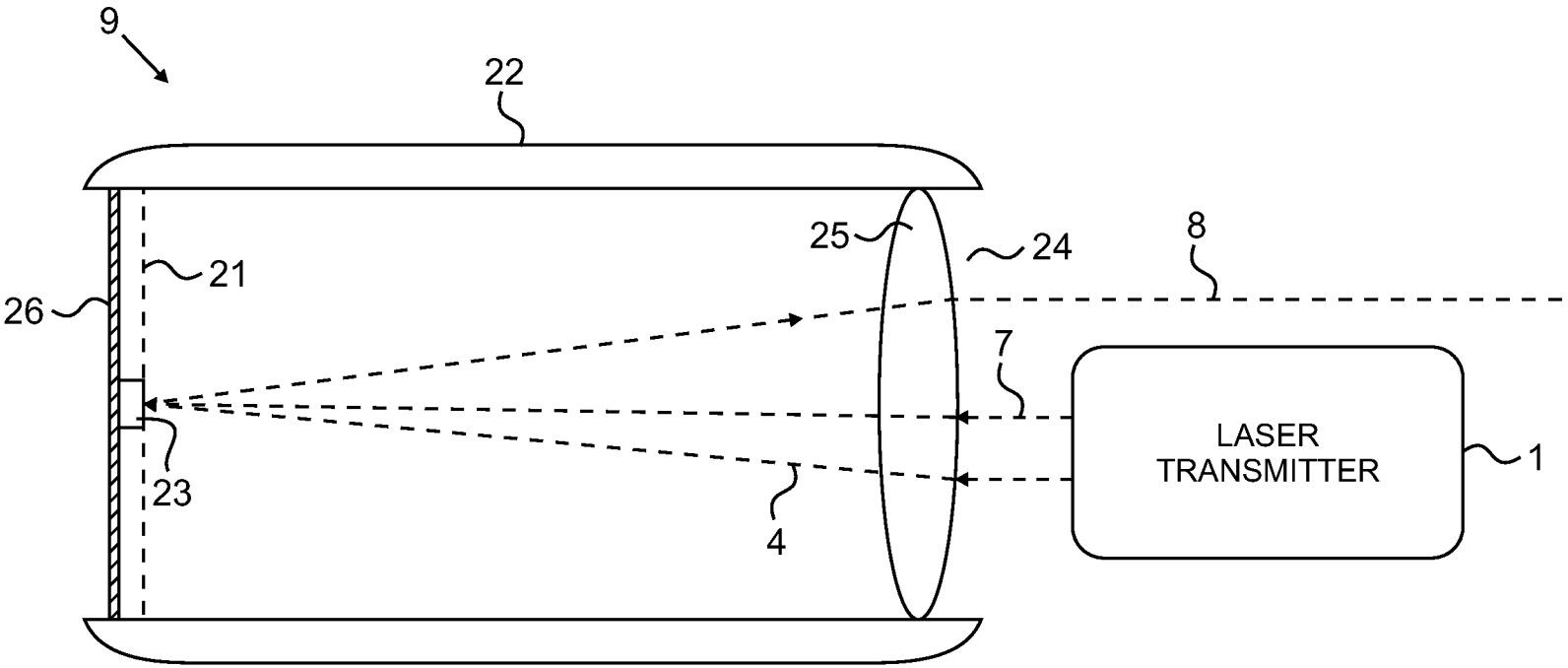
FIG. 3 is a detailed view of one example of the optical system in the alignment device in relation to the optical beams provided by the optical transmitter.

FIG. 3 is a more detailed view of the optical system in the alignment device 9 in relation to the optical beams from the optical transmitter 1. As shown, the alignment device 9 includes a housing 22 with an optical entrance or receiving port 24 for receiving the alignment beam 7 from the optical transmitter. The simulation beam 4 is typically turned off during the alignment process. However, for purposes of illustration the simulation beam 4 is also shown as being received at the receiving port 24 of the alignment device 9. In this particular example the simulation beam 4 and the alignment beam 7 are assumed to be parallel to one another when they are emitted by the optical transmitter 1.

Referring again to FIG. 3, the alignment device 9 includes an optical element or elements that receive the alignment beam 7 (and the simulation beam 4, if present) when it enters the receiving port 24. In this example the optical element is a collimator 25 that focuses the alignment beam 7 in a focal plane 21 located within the housing 22. A projection surface 23, such as a small screen or the like, is located at the focal point of the collimator 25 in the focal plane 21. The image of the alignment beam 7 is thereby presented on the projection surface 23. The projection surface 23 may be any surface upon which the alignment beam 7 may be displayed. In some cases, the projection surface 23 may simply be the back wall 26 of the housing 22. In other examples, the projection surface 23 may be a separate element that is mounted or otherwise secured to the back wall 26. The projection surface 23 will typically be a diffuse surface. In this way, a gunner looking through the sight 3 (FIGS. 1 and 2) of the weapon 2 (FIGS. 1 and 2) will be able to view the image through the collimator 25, along the sighting axis.

The mounting brackets or clamps 10, shown in FIG. 2, are generally ruggedized structural members capable of withstanding shocks and vibrations while also being releasably attachable to the barrel 6 of the weapon 2. Moreover, because of the need for high precision in the alignment between the sight 3 and the optical transmitter 1, the mounting brackets or clamps 10 should tightly and rigidly secure the attachment device to the barrel 6 so that there is no relative movement between them. However, it is also advantageous if the mounting brackets 10 allow quick and easy installation and removal of the alignment device 9 from the weapon 2.

Figure 4:
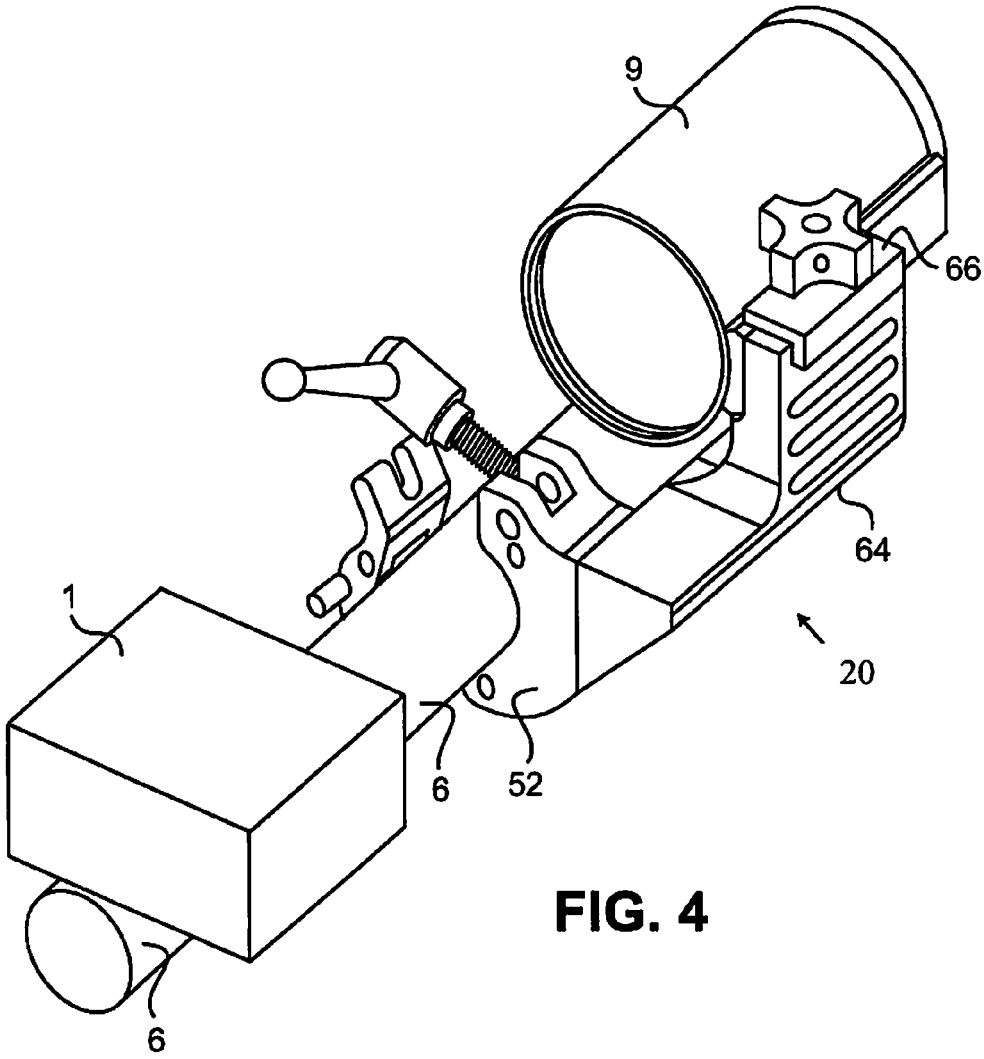
FIG. 4 shows one example of a no-tool clamp arrangement that may be used to secure the alignment device to the barrel of the weapon shown in FIG. 2.

One example of how the mounting brackets 10 (FIGS. 1 and 2) may secure the alignment device 9 to the barrel 6 of the weapon 2 is shown in FIG. 4. As shown, in some implementations the mounting brackets 10 (FIGS. 1 and 2) may be configured as a no-tool clamp arrangement 20, which is a quick-on, quick-off mount that does not require any tools. The no-tool clamp arrangement 20 includes a rail clamp 66 for securing the alignment device 9 to a rail receiver 64 of the no-tool clamp 20 and a barrel clamp 52 for securing the no-tool clamp 20 to the barrel 6 of the weapon 2.

Figure 5:
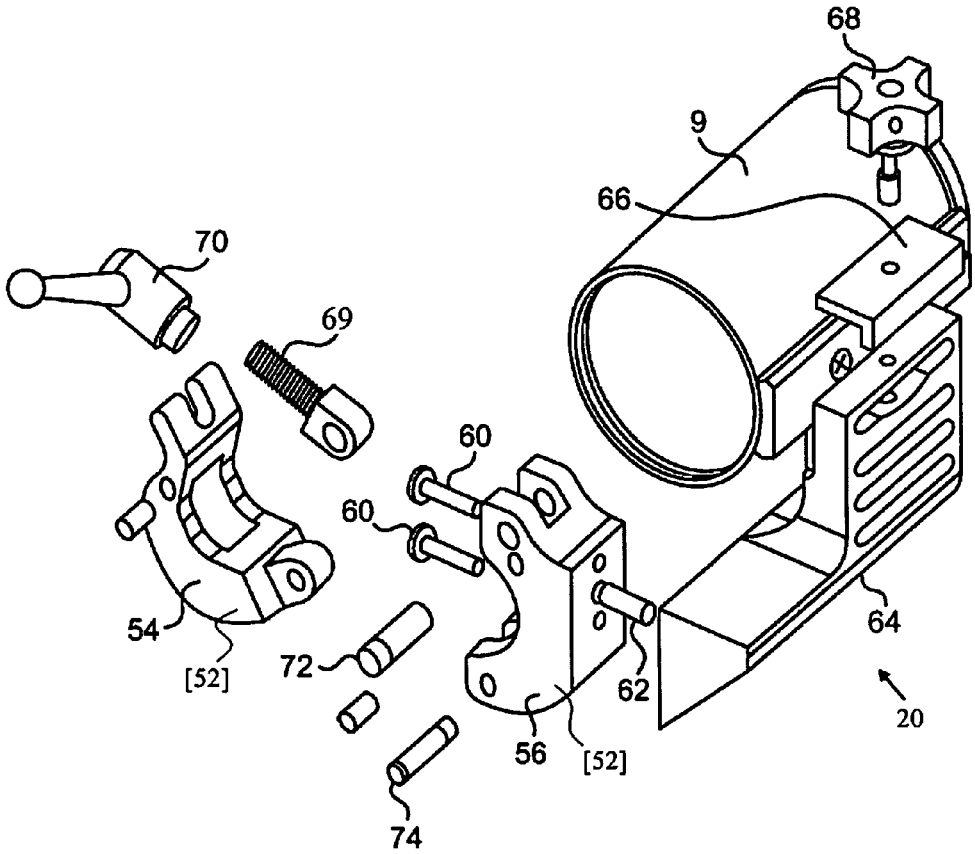
FIG. 5 shows an exploded view of the no-tool clamp arrangement shown in FIG. 4.

FIG. 5 shows an exploded view of the no-tool clamp arrangement 20 shown in FIG. 4. The barrel clamp 52 includes a hinged clamp portion 54 and a fixed clamp portion 56 which are rotatably coupled to one another by an axle pin 74. The fixed clamp portion 56 is secured to the rail receiver 64 by fasteners 60 and locating pin 62. The alignment device 9 is secured to the rail clamp 66 by the rail receiver 64 via an externally threaded knob 68. After the user places the barrel 6 (FIGS. 1 and 2) of the weapon 2 (FIGS. 1 and 2) though the barrel-receiving area of the barrel clamp 52, the hinged clamp portion 54 and the fixed clamp portion 56 are fixedly secured to one another by a hinged threaded rod 69, which is pivotable about axle pin 72. The user rotates the hinged threaded rod 69 into a locked position with an internally threaded locking handle 70. In this way the no-tool clamp 20, and thus the alignment device 9, is secured to the barrel 6 (FIGS. 1 and 2). Likewise, the user can remove the no-tool clamp arrangement 10, and thus the alignment device 9, from the barrel 6 (FIGS. 1 and 2) by releasing rod 69 with the handle 70. Accordingly, the no-tool clamp arrangement 20 allows the alignment device 9 to be quickly connected to and disconnected from the weapon 2 (FIGS. 1 and 2) without the use of any additional tools that would otherwise be needed to tighten bolts and the like.

Of course, the particular mounting bracket shown in FIGS. 4 and 5 represents only one example of a mechanism that may be used to mount the alignment device to the weapon. For instance, in some implementations the mounting bracket 10 (FIGS. 1 and 2) may be configured to interlock with a standardized mounting system that provides a universal method for mounting a wide variety of different accessories to a weapon. One example of such a mounting system is the Picatinny rail that is used for tactical and military weapons. In this case the mounting bracket may be configured so that it can interlock with the Picatinny rail. More generally, the mounting bracket 10 (FIGS. 1 and 2) may employ any type of mounting or locking mechanism including, by way of example, snapping or otherwise interlocking pieces, hand tightenable tension members, clasps, buckles, and the like.

Yet in still other implementations various tools may be provided for use with the tension members so that users can quickly tighten and loosen the tension members for quick installation and de-installation of the mounting brackets 10 (FIGS. 1 and 2).

Figure 6A:
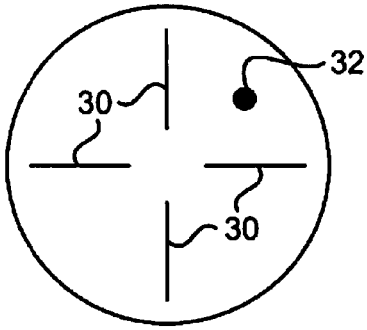
FIGS. 6(*a*) and 6(*b*) show an example of the view that is observed when the user is looking through the sight before and after alignment, respectively.

FIG. 6*a* shows an example of the view that is observed when the user is looking through the sight 3 (FIGS. 1 and 2). In this example the sight 3 (FIGS. 1 and 2) includes a reticle on which cross-hairs or other alignment marks 30 are superimposed. The central point between the alignment marks 30 defines the sighting axis 8 (FIGS. 1-3), which is the direction along which a shot will leave the weapon 2 (FIGS. 1 and 2) when firing with live ammunition. Also visible when looking through the sight 3 (FIGS. 1 and 2) is the image 32 of the alignment beam 7 (FIGS. 1-3) received from the projection surface 23 (FIG. 3).

Figure 6B:
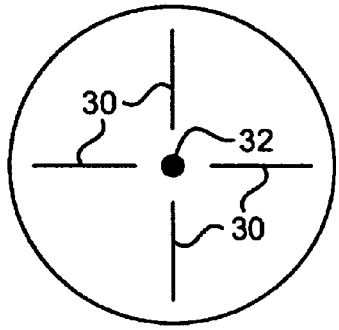

In order to align the alignment beam 7 (FIGS. 1-3) (and in turn, the simulation beam 4 (FIGS. 1-3)) with the aiming axis of the weapon 2 (FIGS. 1 and 2), the image 32 needs to be centrally located in the sight 3 (FIGS. 1 and 2), which in this example is the point at which the alignment marks 30 would intersect one another. This is shown in FIG. 6*b*. The alignment can be accomplished by adjusting an alignment mechanism on the mount that secures the optical transmitter 1 (FIGS. 1 and 2) to the barrel 6 (FIGS. 1 and 2) of the weapon 2 (FIGS. 1 and 2). Suitable mounts may include those discussed above in connection with the alignment device 9 (FIG. 2). Alignment mechanisms may include, for example, set screws or the like which cause adjustment of the mount via any suitable means, including, for instance, gears. Once alignment is complete, the alignment device 9 (FIG. 2) may be removed from the weapon 2 (FIGS. 1 and 2).

The particular projection surface 23 (see FIG. 3) that is employed may be selected based on a variety of factors including, for instance, the intensity of the alignment beam 7 (FIG. 3). For example, in some cases the alignment beam 7 (FIG. 3) may have a relatively high intensity in order to allow it be used for other purposes in addition to alignment. In this case it may be necessary to reduce its intensity before it reaches the sight 3 (FIGS. 1 and 2), where it could cause blooming and perhaps even damage the viewer's eye. Accordingly, the projection surface 23 (FIG. 3) may be a diffusive reflective surface having a relatively low reflectance coefficient (e.g., 0.8 or less) and may even include a light attenuator to attenuate the alignment beam 7 (FIG. 3). In other cases, particularly if the intensity of the alignment beam 7 (FIG. 3) is relatively low, instead of a diffuse surface the projection surface 23 (FIG. 3) may be a specularly reflective surface such a mirror.

In some implementations the optical transmitter 1 (FIGS. 1-3) may be able to adjust the intensity of the alignment beam 7 (FIGS. 1-3) so that it can be reduced to a safe level when seen by the viewer. For instance, the optical transmitter may include a user interface such as a simple switch or the like that can place the transmitter in an alignment mode of operation during which the intensity of the alignment beam is reduced.

In yet another implementation, the alignment beam 7 (FIGS. 1-3) may be eliminated altogether, allowing the simulation beam 4 (FIGS. 1-3) to serve the dual purpose of alignment and simulation. In this case the simulation beam 4 (FIGS. 1-3) may have a wavelength in the visible portion of the electromagnetic spectrum. Alternatively, if the wavelength of the simulation beam 4 (FIGS. 1-3) is outside of the visible spectrum, a wavelength converter may be used to convert its wavelength so that it is translated into the visible portion of the spectrum. The wavelength converter may be located in the housing 22 (FIG. 3) of the alignment device at any point along the optical path traversed by the simulation beam 4 (FIGS. 1-3) between the point where it enters the receiving port 24 (FIG. 3) and the point where it exits the receiving port 24 (FIG. 3) as it travels to the sight 3(FIGS. 1 and 2). For instance, the wavelength converter may be co-located with the projection surface 23(FIG. 3). In some cases the wavelength converter itself may serve as the projection surface 23(FIG. 3). One advantage of using a dual-purpose simulation beam 4 (FIGS. 1-3) is that it is not necessary to be concerned about the alignment between the simulation beam 4 (FIGS. 1-3) and the alignment beam 7 (FIGS. 1-3), which, as noted above, is assumed to be parallel to one another in this particular example.

The alignment device housing 22 (FIG. 3) may or may not be light-tight. If, for instance, the reticle generates its own light in order to make the alignment marks visible, the housing 22 (FIG. 3) may be configured to prevent light from entering except through the receiving port 24 (FIG. 3). In other cases it may important to allow outside light to enter the housing 22 (FIG. 3) so that the viewer will be able to see the alignment marks superimposed on the image of the alignment beam 7 (FIGS. 1-3) projected into the sight 3 (FIGS. 1 and 2).

External light may be allowed to enter the housing 22 (FIG. 3) in any manner. For instance, all or part of the back wall 26 (FIG. 3) of the housing 22 (FIG. 3) may be formed from a translucent diffusing screen or other surface that allows a fraction of the ambient light to enter the housing 22 (FIG. 3) from behind the projection surface 23(FIG. 31. In this way a viewer looking through the site will be able to view the alignment marks and the alignment beam as well as the projection surface 23 (FIG. 3), while sufficient contrast is provided by the diffusing screen so that the projection surface 23 (FIG. 3) remains visible to the viewer.

In those implementations in which light enters the alignment device, one or more apertures may be provided along one or more walls of the housing 22 (FIG. 3). In some cases the size of these apertures may be adjustable with the use of a shutter or the like. In this way the viewer can conveniently control the amount of light that enters the alignment device in order to better optimize the appearance of the alignment beam image in the sight 3(FIGS. 1 and 2). In addition to (or instead of) manual control of the aperture size, automatic control may be provided. For instance, a light sensor may be included in the housing 22 (FIG. 3) to measure the amount of light present. The measured value from the sensor can then be used by a controller to adjust the aperture size in order to maintain some desired light level in the housing 22 (FIG. 3). Such manual or automatic control of the aperture size can allow the alignment device to operate most effectively under different environmental conditions. For instance, the apertures may be adjusted to account for different amounts of sunlight that may be available when the alignment process is being performed.

Figure 7:
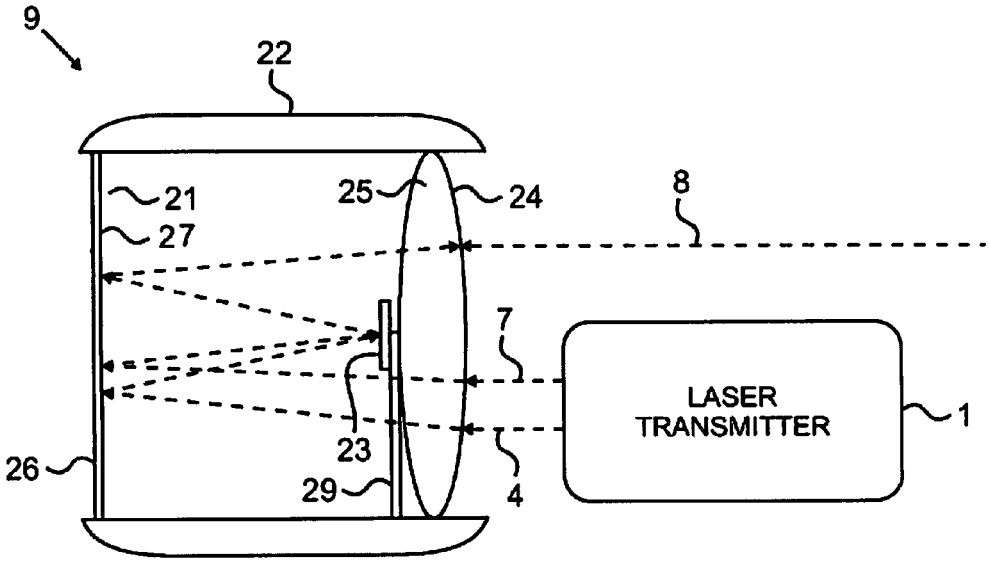
FIG. 7 is a detailed view of an alternative example of the optical system in the alignment device in relation to the optical beams provided by the optical transmitter.

While the embodiment of the alignment device shown in FIG. 3 is already relatively compact in comparison to conventionally used alignment techniques, its size can be reduced even further by folding the optical path between the collimator 25 and the projection surface 23. One example of such an arrangement is shown in FIG. 7. In this example the projection surface 23 is positioned along the optical axis of the collimator 25 at a location on or near the collimator 25. The back wall 26 of the housing 22 is provided with a planar mirror 27 that receives the alignment beam 7 from the collimator 25 and reflects it back toward projection surface 23. As shown in FIG. 7, a diffusing material 29 may be placed between the projection surface 23 and the collimator 25 so that it intersects alignment beam 7 and simulation beam 4 in order to improve contrast.

As previously mentioned, the alignment device described above can be used even if the simulation beam and the alignment beam are not parallel to one another, provided that the two beams leave the optical transmitter in a fixed and known angular relationship to one another.

Figure 8:
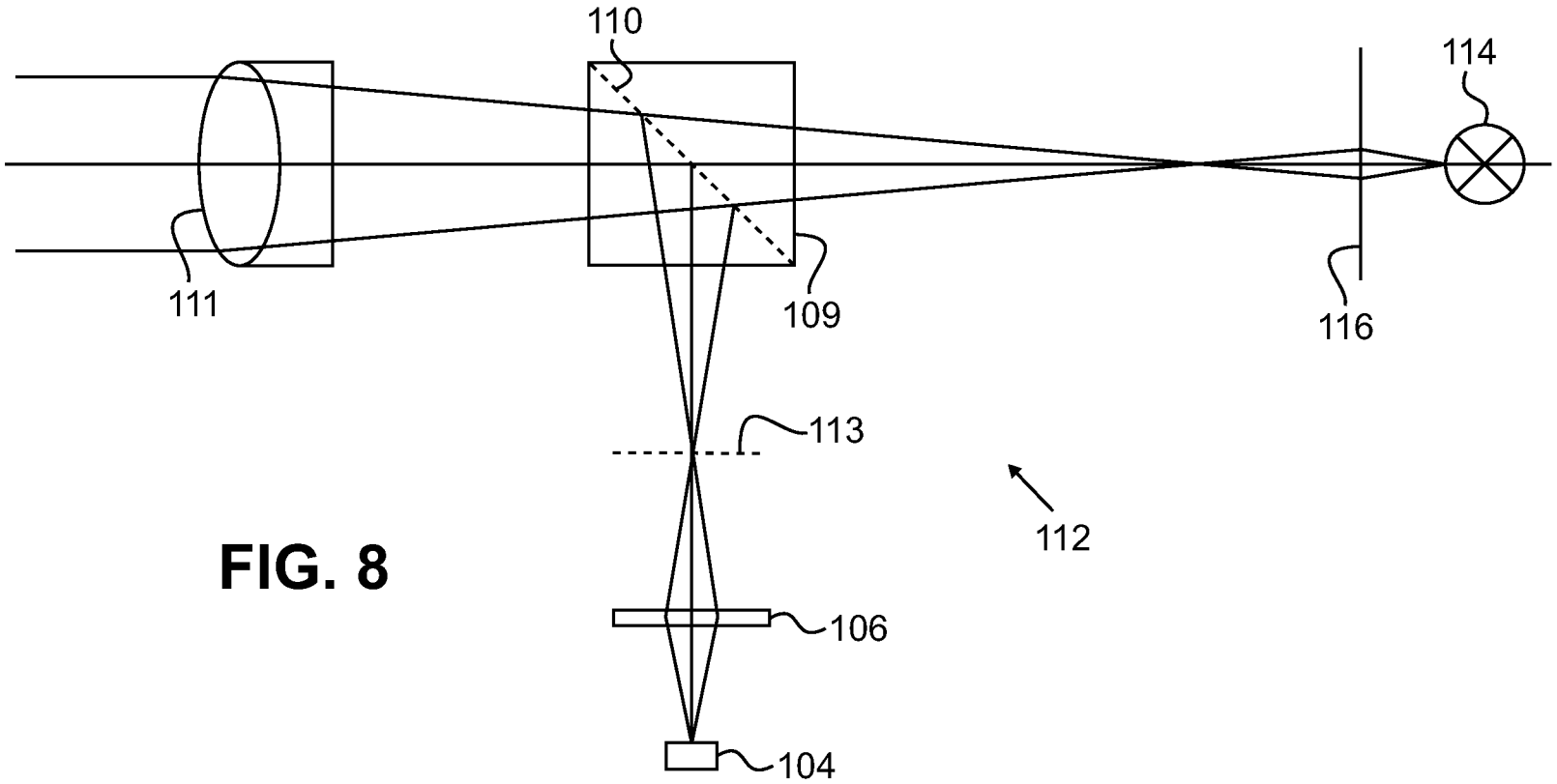
FIG. 8 shows one example of the optical system that may be employed by optical transmitter 1.

FIG. 8 shows one example of the optical system 112 that may be employed by optical transmitter 1. The simulation beam is generated by a laser emitter 104 in the form of, e.g. a laser or diode. The laser emitter 104 generates a beam of energy at one or more optical wavelengths, which may include both visible and non-visible wavelengths such as infrared and ultraviolet wavelengths. In one example, a semiconductor laser may be employed operating at infrared wavelengths between about 880 nanometers nm and 10 microns. In one particular example the laser may be centered at about 904 nanometers and extend from about 880 nanometers to about 950 nanometers. The output power of the laser may be, for example, about 0.6 ergs per pulse or less. Of course, lasers operating at other optical wavelengths and output powers may be used as well.

In some implementations it may desirable to improve the circular symmetry and size of the simulation beam generated by the laser emitter. This result may be achieved in a number of different ways. For example, an optical fiber (not shown) may be arranged in the beam path of the laser emitter 104 so that the beam is reflected a number of times inside the fiber, thereby achieving a more symmetrical distribution across the beam diameter. Alternatively, a beam-shaping optical component 106 may be arranged in the beam path from the laser emitter 104 with essentially positive refractive power containing at least one diffractive transmitting surface or aspherical refractive surface.

A beam splitter 109 receives the simulation beam from the laser emitter 104 (or the beam-shaping optical component 106, if employed). The beam splitter 109 has a beam-splitting layer 110 arranged so as to reflect a significant part of the simulation beam toward a projection lens 111. If employed, the beam-shaping optical component 106 is positioned so that the focal plane 113 of the projection lens 111 along this optical path, after reflection by the beam-splitting layer 110, lies at the point where the simulation beam from the beam-shaping optical component 106 has the desired symmetrical shape.

A visible light emitter 114, such as a light-emitting diode, is arranged to generate the alignment beam. As with the laser emitter 104, the circular symmetry of the alignment beam optionally may be improved with the use of an optical fiber or a beamshaping optical component 116, which is positioned relative to the focal plane of the projection lens 111 so that the alignment beam from the beam-shaping optical component 116 has the desired symmetrical shape. The beam splitter 109 receives the alignment beam from the visible light emitter 114 (or the beam-shaping optical component 106, if employed). A portion of the alignment beam passes through the beam-splitting layer 110, while a second part is reflected away from the optical system 112.

In the example shown in FIG. 8 the laser emitter 104, the light emitter 114 and the beam splitter 109 are positioned so that both the simulation beam and the alignment beam strike the beam-splitting layer 110 and form a composite beam that is directed toward the projection lens 111. After passing through the projection lens 111, the simulation beam and the alignment beam leave the optical transmitter 1 along a common axis. That is, in this example the optical transmitter generates both beams so that they both travel along the optical paths of either the simulation beam 4 or the alignment beam 7 shown in FIG. 3. Of course, in other implementations the optical system 112 of optical transmitter 1 may be arranged to generate the simulation and alignment beams along two different but parallel paths, as shown in FIG. 3. Moreover, in yet other implementations, the simulation and alignment beams may travel along non-parallel paths, provided that they remain in a fixed angular relationship to one another.

In some cases the placement of the visible light emitter 114 and the laser emitter 104 may be reversed so that the beam-splitting layer 110 allows the simulation beam to pass through it in the direction toward the projection lens 111 and reflects the alignment beam toward the projection lens 111.

Figure 9:
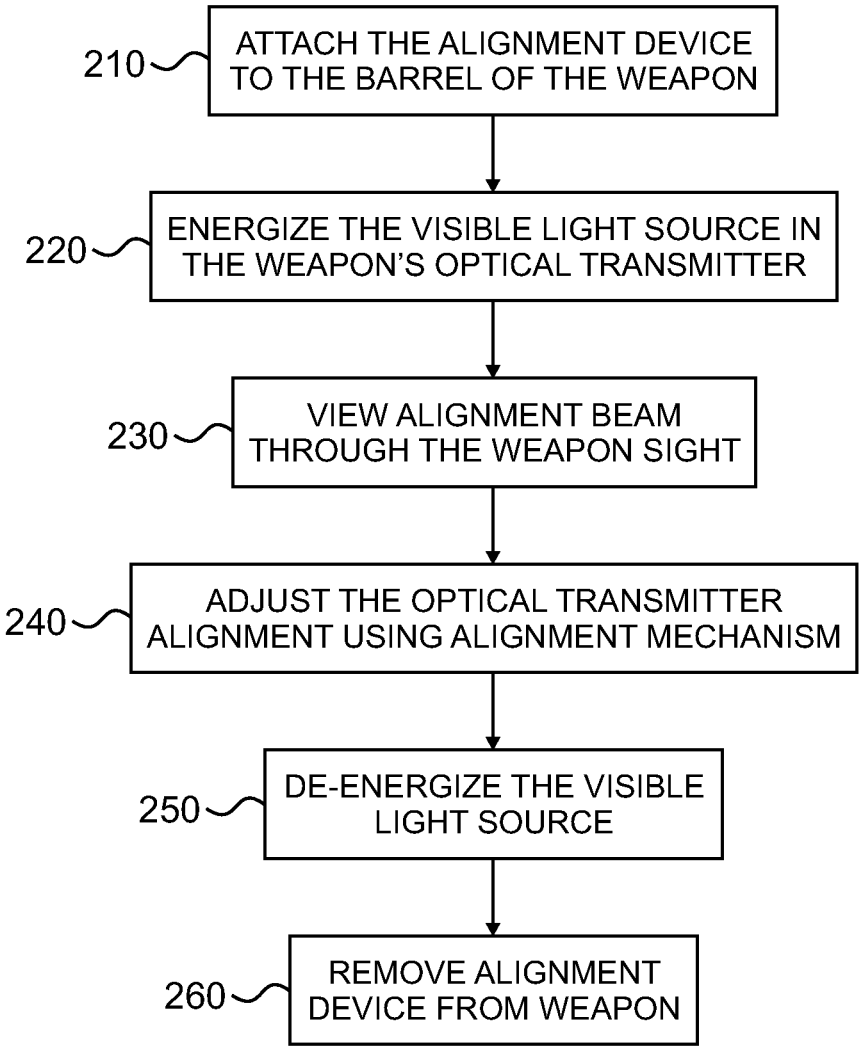
FIG. 9 is a flowchart showing one example of a method for aligning the sight axis of a weapon with the simulation beam axis of the optical transmitter using an alignment device of the type described herein.

FIG. 9 is a flowchart showing one example of a method for aligning the sight axis of a weapon with the simulation beam axis of the optical transmitter using an alignment device of the type described above, an example of which is shown in FIG. 3. The method begins at block 210 when the user attaches the alignment device to the barrel of the weapon. Once the alignment device is properly secured to the weapon, at block 220 the user energizes the visible light source in the weapon's optical transmitter. In one example, the visible light source can be a laser light source generating light at a visible wavelength. In some cases the user may also energize the simulation beam light source, but its activation is not a requirement. Activation of either light source may be performed via any suitable user interface such as a series of buttons or switches located on the exterior of the optical transmitter.

After energizing the visible light source, the method proceeds to block 230. At block 230, the user views the alignment beam through the sight of the weapon. If the alignment beam does not appear at the target point in the sight (e.g., at the center of the cross-hairs) the simulation beam is not properly aligned. Assuming that alignment is needed, at block 240 the user adjusts the alignment using the alignment mechanism on the mounting brackets of the optical transmitter. Depending on the nature of the mount, this may require the user to rotate one or more set screws, gears or the like in order to adjust both the azimuth and elevation axes. In other implementations the mount may be motorized so that the user can adjust the position and orientation of the optical transmitter using a user interface that serves as a beam steerer, such as a joystick or the like. After the alignment beam is properly aligned in the sight, the user can optionally de-energize the visible light source at block 250, both in order to conserve battery power, if used, and to provide a more realistic weapon simulation. Finally, in step 260 the alignment device is removed from the weapon, which is now ready for use in a simulation environment.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A method for facilitating alignment of a sighting axis of a sight mounted on a simulated weapon, comprising:

receiving at an optical collimator an optical alignment beam emitted from an optical transmitter located on the simulated weapon, the optical transmitter, the sight and the optical collimator all being in a mechanical relationship with one another;

focusing the optical alignment beam onto a planar mirror housed in the alignment device, the planar mirror being positioned along an optical axis of the optical collimator and spaced apart from the optical collimator and;

reflecting the optical alignment beam onto a projection surface of the alignment device, the projection surface disposed along the optical axis of the optical collimator and between the optical collimator and the planar mirror; and displaying an image of the optical alignment beam appearing on the projection surface so that it is visible to a viewer through the sight.

2. The method of claim 1, wherein the projection surface is a diffuse reflecting surface.

3. The method of claim 1, further comprising attenuating the optical alignment beam so that it is attenuated when viewed through the sight by the viewer.

4. The method of claim 1, wherein the optical alignment beam is received along a first optical path that is parallel to a second optical path along which a simulation beam is transmitted by the optical transmitter.

5. A simulated weapon for simulating ammunition fired at a target comprising:

a firearm housing including a barrel though which ammunition is to be fired;

a sight secured to the firearm housing for defining a sighting axis along which ammunition would leave the barrel of the weapon upon firing;

an optical transmitter mechanically coupled to the barrel of the firearm housing for emitting at least one optical beam, at least one of said optical beams being a simulation beam for simulating the ammunition;

an alignment device removably securable to the barrel of the firearm, said alignment device including:

an optical collimator that intersects the sighting axis and an axis of a first of the at least one optical beam emitted by the optical transmitter;

a projection surface positioned along an optical axis of the optical collimator upon which the first optical beam is focused by the optical collimator; and a planar mirror, spaced apart from the optical collimator and the projection surface and positioned along the optical axis of the optical collimator, wherein the planar mirror is positioned to (i) receive the first optical beam from the optical collimator and reflect the first optical beam to the projection surface positioned between the planar mirror and the optical collimator and (ii) receive an image of the first optical beam from the projection surface and reflect it to the sight so that an image of the first optical beam is visible through the sight along the sighting axis.

6. The simulated weapon of claim 5 wherein the alignment device includes a housing and the optical collimator is positioned in the housing to receive the first optical beam through an entrance in the housing.

7. The simulated weapon of claim 5, wherein the projection surface is a diffuse reflecting surface.

8. The simulated weapon of claim 6, wherein the housing includes one or more apertures.

9. The simulated weapon of claim 6, further comprising an optical diffusing material located along the optical axis of the first optical beam and between the optical collimator and the projection surface.

10. The simulated weapon of claim 5, wherein the projection surface includes an attenuator for attenuating the first optical beam.

11. The simulated weapon of claim 5, wherein the one or more optical beams include the first optical beam which serves as an alignment beam and a second optical beam for simulating the ammunition, said first optical beam being in a visible portion of the electromagnetic spectrum.

12. The simulated weapon of claim 5, further comprising a securing arrangement for removably connecting the alignment device to the barrel of the firearm housing without use of tools.

13. The simulated weapon of claim 12, wherein the securing arrangement includes a hinged clamp having a barrel receiving area for receiving the barrel of the firearm housing, said hinged clamp having a hinged threaded rod and a locking handle for manually locking the hinged clamp to the barrel of the weapon.

14. A method of aligning a sighting axis of a sight mounted on a weapon with a simulation axis of an optical simulation beam generated by an optical transmitter mounted on the weapon, wherein the optical simulation beam simulates ammunition fired at a target, comprising:

attaching an alignment device to the weapon so that an optical collimator dispensed in the alignment device intersects the sighting axis and an optical axis of a visible optical beam generated by the optical transmitter;

viewing an image of the visible optical beam through the sight, said image being directed to the sight by a planar mirror located in the alignment device, said planar mirror spaced apart from the optical collimator and a projection surface and positioned to (i) receive the visible optical beam from the optical collimator and reflect the visible optical beam to the projection surface and (ii) receive an image of the visible optical beam from the projection surface and reflect it to the sight; and adjusting the visible optical beam so that its optical axis is aligned with the sighting axis.

15. The method of claim 14, wherein the simulation axis and the optical axis of the visible optical beam are parallel to one another.

16. The method of claim 14, further comprising turning off the visible optical beam and turning on the optical simulation beam.

17. An alignment device of a simulated weapon having a sight and an optical transmitter, comprising:

an optical collimator positioned to intersect a sighting axis of the sight and an axis of an optical beam emitted by the optical transmitter;

a projection surface positioned along an optical axis of the optical collimator at or near the optical collimator; and a planar mirror, spaced apart from the optical collimator, positioned along the optical axis of the optical collimator, and positioned to (i) receive the optical beam from the optical collimator and reflect the optical beam to the projection surface and (ii) receive an image of the optical beam from the projection surface and reflect it to the sight such that an image of the optical beam is visible through the sight along the sighting axis.

18. The alignment device of claim 17, further comprising:

a housing having an entrance, wherein the optical collimator is positioned in the housing to receive the optical beam through the entrance in the housing.

19. The alignment device of claim 17, wherein the projection surface is a diffuse reflecting surface.

20. The alignment device of claim 18, wherein the housing includes one or more apertures.

21. The alignment device of claim 17, further comprising:

an optical diffusing material located between the optical collimator and the projection surface and along the optical axis of the optical beam.

22. The alignment device of claim 17, wherein the projection surface includes an attenuator for attenuating the optical beam.

23. The simulated weapon of claim 13, wherein the clamp arrangement further includes a rail receiver removably securable to the fixed clamp portion of the hinged clamp, said rail receiver having a first portion that extends along the barrel and a second portion that extends perpendicular to the first portion, and a rail clamp removably securable by a fastener to the second portion of the rail receiver and the alignment device.

24. The alignment device of claim 17, further comprising a removable securing arrangement for connecting the alignment device to a barrel of the simulated firearm, the removable securing arrangement comprising:

a hinged clamp having a barrel receiving area, said hinged clamp comprising a hinged clamp portion rotatably and removably coupled to a fixed clamp portion by an axle, a hinged threaded rod rotatably and removably coupled to the hinged clamp portion by a second axle, and an internally threaded handle rotatably and removably coupled to the hinged threaded rod;

a rail receiver removably securable to the fixed clamp portion of the hinged clamp, said rail receiver having a first portion that extends along the barrel and a second portion that extends perpendicular to the first portion; and a rail clamp removably securable by a fastener to the second portion of the rail receiver and the alignment device.

* * * * *